US005235757A

United States Patent [19]

Josefsson et al.

[11] Patent Number: 5,235,757

[45] Date of Patent: Aug. 17, 1993

[54] METHOD AND APPARATUS FOR DISTRIBUTING AIRFLOW IN A PAINT BAKING OVEN CONVECTION ZONE

[75] Inventors: Leif E. B. Josefsson, Sterling Heights, Mich.; Anders P. A. T. Persson, Vaxjo, Sweden

[73] Assignee: ABB Flakt, Inc., Madison Heights, Mich.

[21] Appl. No.: 751,715

[22] Filed: Aug. 29, 1991

[51] Int. Cl.[5] ..... F26B 7/00

[52] U.S. Cl. ..... 34/18; 34/68

[58] Field of Search ..... 34/17, 18, 68, 60, 39

[56] References Cited

U.S. PATENT DOCUMENTS

| | | | |
|---|---|---|---|
| 1,513,161 | 10/1924 | Darrah . | |
| 1,566,275 | 12/1925 | Harrison . | |
| 1,706,554 | 3/1929 | Weber . | |
| 2,140,337 | 12/1938 | Somes | 34/46 |
| 2,745,190 | 5/1956 | Moule | 34/12 |
| 3,667,132 | 6/1972 | Herbert, Jr. | 34/18 |
| 4,287,671 | 9/1981 | Koch, II | 34/18 X |
| 4,336,279 | 6/1982 | Metzger | 34/18 X |
| 4,359,826 | 11/1982 | Rounsley | 34/18 X |
| 4,771,552 | 9/1988 | Morioka | 34/222 |
| 4,890,394 | 1/1990 | Troetscher | 34/17 X |

FOREIGN PATENT DOCUMENTS

| | | |
|---|---|---|
| 451100 | 7/1943 | Belgium . |
| 2338871 | 2/1975 | Fed. Rep. of Germany . |

OTHER PUBLICATIONS

PCT International Search Report of PCT Int'l Appl. No. PCT/US92/07253, filed Aug. 27, 1992 of ABB Flakt, Inc.

*Primary Examiner*—Martin P. Schwadron
*Assistant Examiner*—Kevin L. Lee
*Attorney, Agent, or Firm*—Harness, Dickey & Pierce

[57] ABSTRACT

A convection air holding zone utilizes turbulent ejector air flow along paths parallel to the path of travel of the article being baked in a paint bake oven. Air recirculation means are provided within the convection air holding zone which filters dirt particles from the air and a heat source is applied to the air to compensate for temperature loss due to heat exchange with the article and oven walls. Maintaining a turbulent air flow over the articles being baked in the convection air holding zone helps insure an even temperature throughout the zone, thereby enabling a more consistent paint finish on the article.

12 Claims, 3 Drawing Sheets

METHOD AND APPARATUS FOR DISTRIBUTING AIRFLOW IN A PAINT BAKING OVEN CONVECTION ZONE

BACKGROUND OF THE INVENTION

1. Field of the Invention

This invention relates to paint baking ovens. More particularly, the invention relates to apparatus for distributing airflow along paint baking oven convection air holding zones with a high degree of turbulence.

2. Description of Related Art

Paint baking ovens are used throughout the manufacturing industry to bake the paint or coating applied to various articles such as automobile components. Such paint baking ovens often have conveyors or similar devices for bringing the component to be baked into the paint baking oven and then to carry the component through the various sections or zones of the paint baking oven. While the component is within the convection air holding zone(s) of the paint baking oven, heated air is blown over the surface of the component to achieve an even temperature over the surface of the component. This air is also useful to evaporate solvents and/or resins which are driven from the component during the paint baking process. After the component has been completely baked, the component exits the paint baking oven and continues on in the manufacturing process for attachment of outer body moldings and other parts.

Designers of paint baking ovens have traditionally attempted to deal with improving the final appearance of the paint or finish applied to the component by limiting variations in temperature occurring over the component within the various sections or zones of the paint baking oven. Particular attention has been focused on maintaining a constant temperature over the component surface while within the convection air holding zone(s) of the oven.

None of the art known to applicants suggest distributing airflow via ejector action longitudinally along a paint baking oven convection air holding zone with a high degree of turbulence to move all the air through the holding zone to maintain a constant temperature over the component thereby increasing paint baking efficiency.

Additionally, none of the art presently known to the applicants suggests reheating and recirculating the volume of air which is not exhausted back into the paint baking oven convection zone with turbulence.

SUMMARY OF THE INVENTION

Accordingly, the invention provides a paint baking oven having an outer ceiling and a floor interconnected by two sidewalls to define a tunnel with air sealed entrance and exit ends, with articles to be baked moving longitudinally along and through the tunnel from the entrance end to the exit end. Air inlet means located at the entrance and exit ends are provided for directing air into convection air holding zones along a path substantially parallel to the path of travel of the article to be baked. Air distribution means for directing, via ejector action, air longitudinally along convection air holding zones with a high degree of turbulence are also provided. An air exhaust apparatus extending from the paint baking oven at a pre-selected location in the tunnel between the entrance and exit ends is operative to withdraw solvent and/or resin laden air.

It is a feature of this invention that air which is not exhausted be recirculated into the convection air holding zones with turbulence in a direction of travel generally parallel to that of the article being baked, thereby maintaining heated air in contact with the article for prolonged periods of time to improve paint baking efficiency.

It is a further feature of this invention to provide a greater turnover of air within the convection zone(s) thereby providing a more consistent temperature on the article which helps eliminate over and underheating various areas of the component.

Additionally, in combination with the longitudinal turbulent air flow through the convection zone(s), the invention contemplates a means of reheating the convection air which is not exhausted. In one embodiment of the present invention, the recirculation air which has passed through the convection air holding zones is filtered by a heat pump type blower prior to being reheated and injected back into the convection air holding zone(s) with a high degree of turbulence. In a second embodiment of the present invention, dark radiation panels are aligned along the sidewalls of the paint baking oven convection zone to provide heat to compensate for heat losses brought about through heat transfer with the oven parts.

BRIEF DESCRIPTION OF THE DRAWINGS

The objects and features of the invention will become apparent from a reading of the detailed description taken in conjunction with the drawings, in which.

DETAILED DESCRIPTION OF THE PREFERRED EMBODIMENTS

Figure 1:
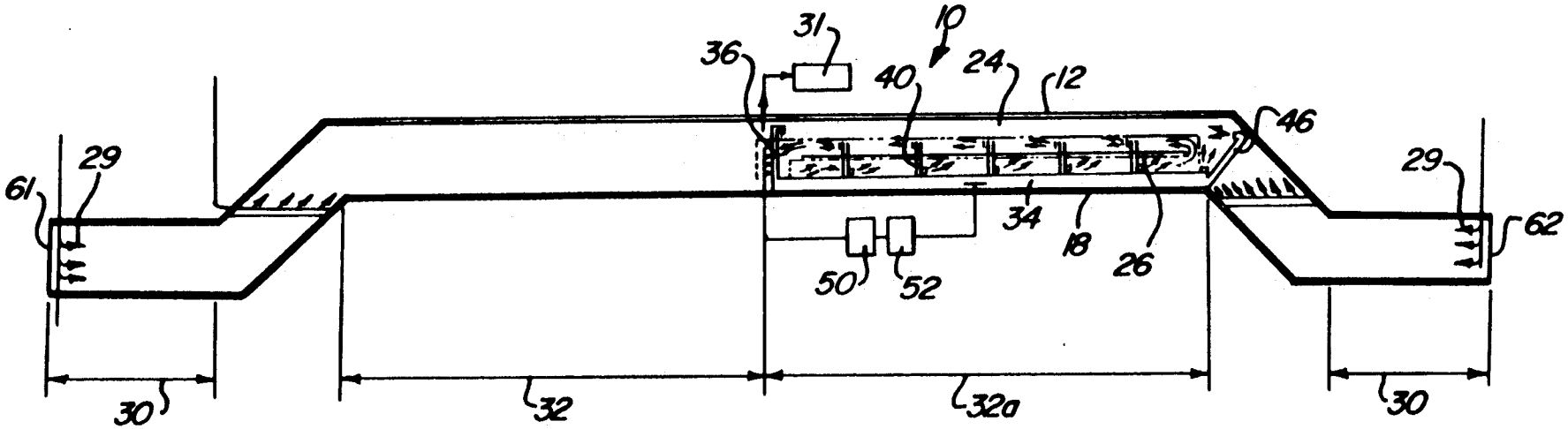
FIG. 1 is a side view partially in cross-section of paint baking oven in accordance with the principles of the invention.

Three of the more common types of paint baking ovens include the camel-back, straight through and A-oven designs. For simplification, the present invention will be described as it would be utilized in a camel-back type paint baking oven. It will be understood by those skilled in the art that the present invention may be employed within various other types of paint baking ovens, including the straight through and A-oven designs and that the following description should not be specifically limited to the camel-back oven design.

With reference to FIGS. 1–5, a paint baking oven 10 includes an outer ceiling 12 and a floor 18 connected by two sidewalls 14 and 16. The camel-back paint baking oven 10 is an elongated tunnel having first and second end sections which are separated by an extending hump located above the two end sections. The articles to be baked move longitudinally along a path of travel parallel to the longitudinal axis of the zone or section through which it is passing on a conveyor 20 from a sealed entrance end 61 to a sealed exit end 62. The paint baking oven 10 is used to bake various types of articles which are generally designated by the numeral 28. Although an automobile component 28 has been chosen for demonstrative purposes, it will be understood that the paint baking oven 10 may be used to bake other types of articles in addition to the automobile components 28.

The component 28 initially enters the paint baking oven 10 on conveyor 20 through an air sealed silhouette (not shown) located at the entrance end 61 of the paint baking oven 10. This component 28 advances within the paint baking oven 10 upon conveyor 20 first through a bring up zone 30 and then into a section of the paint baking oven 10 referred to in the industry as a convection air holding zone 32.

Within the bring up zone 30, radiation is applied to the surface of the component 28 by one or more dark radiation panels generally positioned along the ceiling, two sidewalls and floor as the means of increasing the component temperature. By increasing the component temperature, solvents and/or resins which were not evaporated off prior to entering the paint baking oven will be further evaporated from the component 28 so that the paint or finish coating on the component may be skin dried. Normal temperatures on these dark radiation panel surfaces range from between 175°-350° C.

After skin drying the paint or other finish contained on component 28, the conveyor 20 then advances the component 28 into the paint baking oven convection air holding zone 32. It is in this section of the paint baking oven 10 that the component 28 becomes baked due to a chemical reaction.

The bottom of this convection air holding zone 32 is located at least 0.5 meters above the top of the first bring up zone 30 in the camel back oven design. This height differential provides a thermal lock which helps to reduce leakage out of hot air and in of cold air at the air seals which helps prevent undesirable condensation of solvents and resins.

Typically, two separate and distinct convection air holding zones 32 and **32*a* are provided contiguously within the paint baking oven. Exhaust means 31 extend from the paint baking oven 10 where the two convection air holding zones 32 and 32*a* come together. Air is continuously blown through each of these convection air holding zones 32 and 32*a*** toward the middle of the oven to help exhaust solvent and resin laden air.

Figure 2:
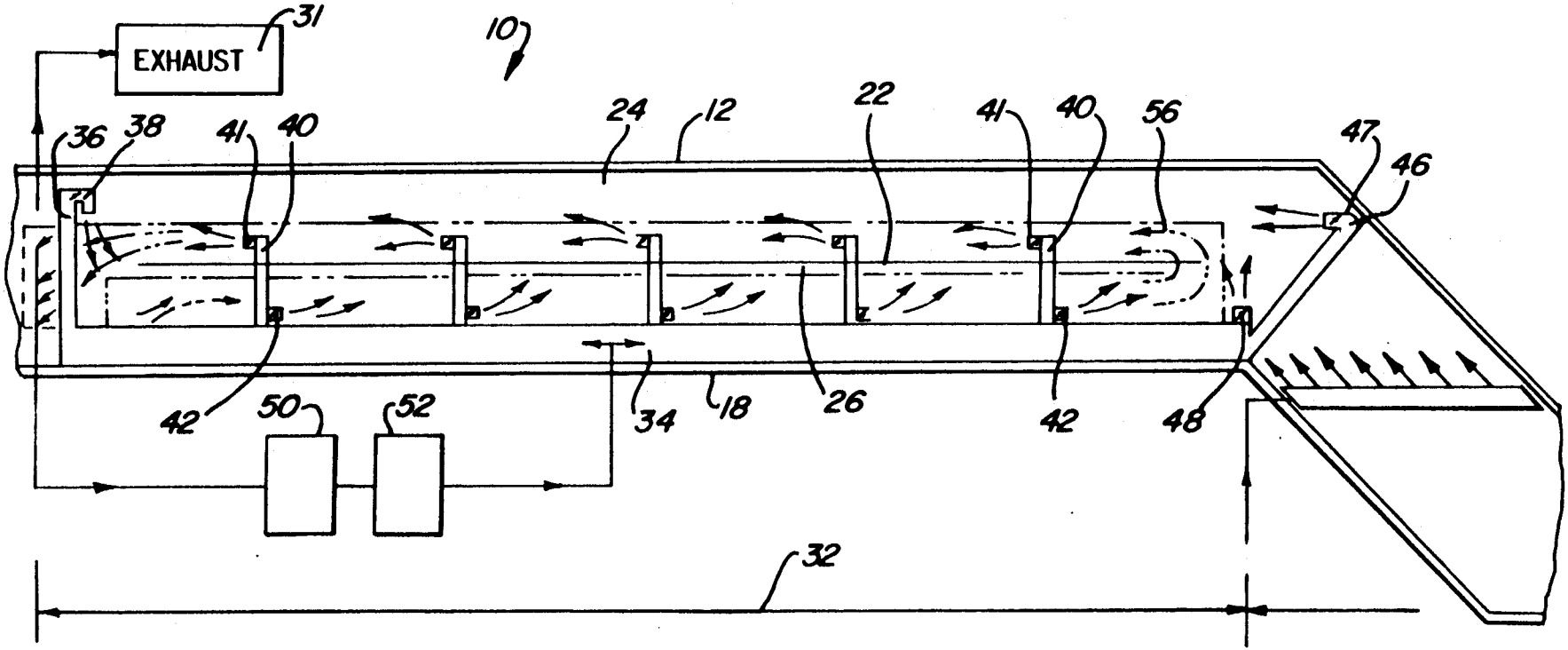
FIG. 2 is a cross-sectional side view of the convection air holding zone of FIG. 1 arranged in accordance with the principles of the invention.
Figure 3:
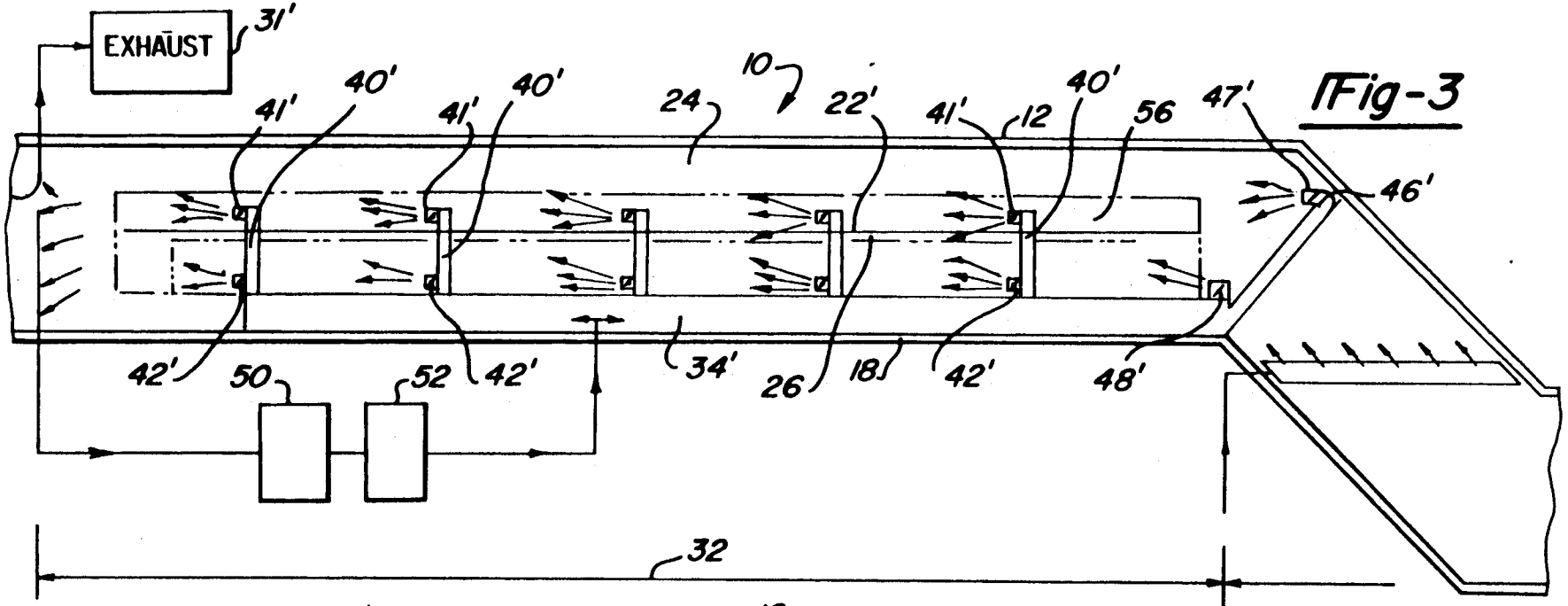
FIG. 3 is a cross-sectional side view showing an alternative embodiment of a paint baking oven convection air holding zone in accordance with the principles of the invention.

FIGS. 1, 2, and 3 show a convection air holding zone 32, according to the present invention wherein a partition 22 projects outwardly from both sidewalls 14 and 16 and extends longitudinally the length of the convection air holding zone 32. The partition 22 which is comprised of tempered steel separates the convection air holding zone 32 into distinct upper and lower sections 24 and 26, respectively.

Air distribution means are also provided within the convection air holding zone 32 of the present invention which allow for recirculation of the inlet air after it has initially passed through the convection air holding zone 32. As the air passes through the convection air holding zone 32, it sweeps evaporated solvents and resins given off during the baking process. A volume of air substantially equal to that volume of fresh air introduced from outside the oven (e.g. at arrows 29 of FIG. 1) is removed from the oven via exhaust means 31. This exhausted air is then passed through an incinerator to burn off the solvents and resins prior to releasing the exhaust air into the atmosphere.

The remaining portion of the air contained in the convection air holding zone 32 is recirculated and returned to the convection air holding zone 32 to be recirculated over the component 28.

This recirculation occurs as a heat pump type blower 52 draws the recirculation air in through a filtration system 50. After filtration, the air is injected into ducts 34, which run longitudinally along the base of both sidewalls 14 and 16 of convection zone 32. The ducts 34 are provided with numerous projecting hollow tube members 40 which extend into the area of the convection air holding zone 32 above the floor 18 where the hot air is blown over the component 28 being baked.

According to the embodiment of FIGS. 1 and 2, the tubes 36 and 46 extending upwardly from each end of the ducts 34 have air plenums and nozzles 41 which direct recirculation air in opposite directions above and below partition 22 with a pumping or ejector effect—i.e. the higher velocity of heated air exiting nozzles 41 acts to move the entire air volume within the zone (including fresh air introduced at inlet and outlet ends of the oven) in a preselected direction. The first end tube 36 located proximate to the center of the camel-back oven is equipped with a downwardly projecting plenum and nozzle 38 at the top thereof which directs recirculated air below partition 24 along a longitudinal path in the direction of the second end tube 46. Second end tube 46 is provided with a pair of plenums and nozzles 47 and 48 which direct recirculated air from end tube 46 above the partition 22. As a result, the ejector air is introduced so as to effect movement of all air within the convection zone in a couterclockwise direction as seen in FIGS. 1 and 2 about partition 22.

Each of the centrally located tubes 40 of FIGS. 1 and 2 positioned between the two end tubes 36 and 46 along ducts 34 are provided with a pair of diametrically opposed air plenums and nozzles 41 and 42 positioned on the top and bottom thereof, respectively. The top plenums and nozzles 41 extend into the upper section of the convection air holding zone 32 above the partition 22 to act as an ejector to move air passing therethrough. Air plenums and nozzles 42 located on the bottoms of tubes 40 are positioned below the partition 22 and direct the air longitudinally below partition 22 in a direction opposite to that of air movement above partition 22.

In a second embodiment of the present invention according to FIG. 3, tube 46' extends upwardly from the end of ducts 34' at a 45 degree angle. Tube 46' is provided with a pair of air plenums and nozzles 47' and 48' which direct the ejector air toward the center of the paint baking oven 10. Plenum 47' serves to direct air above partition 22' and plenum 48' serves to direct air below partition 22'. The more centrally located tubes 40' which extend upwardly from ducts 34' are provided with a pair of air plenums and nozzles 41' and 42' both of which also direct the ejector air passing therethrough toward the center of the paint baking oven 10. Plenums and nozzles 41' extend above partition 22' and plenums and nozzles 42' extend from tubes 40' below partition 22'.

To utilize the improved convection air holding zone 32 of the present invention, heated fresh air is introduced into the convection air holding zone 32 through air seals contained at both the entrance end 61 and exit end 62 of the paint baking oven 10 (FIG. 1). This heated inlet air typically has a temperature significantly higher than the temperature of the air already contained in the paint baking oven 10. For example, if the paint baking oven temperature is required to be 150° C. to sufficiently bake the component in the convection air holding zone 32, the heated fresh inlet air will typically be between 200° C.–250° C. to compensate for heat loss resulting from contact with the component 28 and from air infiltrating from outside the oven as painted objects enter and exit the oven ends 61 and 62.

The heated fresh inlet air is introduced horizontally above the equilibrium temperature levels contained within the bring up zone 30 (or within another type entrance area of the oven) as shown by arrows 29 at a relatively low velocity. Typically a velocity of between 0.5–1.5 meters per second (m/s) will be sufficiently low. The volume of inlet air introduced into the paint baking oven 10 is directly proportional to the amount of air simultaneously being exhausted from convection air holding zone 32 via exhaust system 31. A venturi can be used to monitor and control the amount of air exhausted and the amount of air let into the convection air holding zone 32.

Hot fresh inlet air rises to the top of the paint baking oven 10 and passes longitudinally along the convection air holding zone 32 above partition 22 carrying with it vaporized solvents and resins given off by the component 28 during the paint baking process. The fresh inlet air mixes with the ejector air emanating from nozzles 41. To maintain inlet/outlet air balance, a substantially equal air volume to that introduced as fresh inlet air is withdrawn via exhaust system 31 for incineration of entrained resins and solvents.

In the embodiment of FIG. 2, a heat pump-type blower 52 draws the air to be recirculated in through a filtration system 50 having EU 7 quality filter. EU 7 quality filters tend to trap condensed solvents and resins, along with any dirt particles, which escaped initial exhaustion without significantly restricting the airflow throughout the convection air holding zone 32. After filtration, the recirculation air is drawn into and through the blower 52 where it is reheated to accommodate for any loss in air temperature, which resulted from passing the air over the component or resulted from heat exchange with the internal components of the oven. Generally, heat pump type blower 52 consists of a natural gas fueled heating unit wherein the temperature can be varied over a relatively broad range allowing for differences in the types of paint or finish applied to the components. Normal temperatures for this recirculation air range from 140°–220° C., although other temperatures can be achieved.

Figure 5:
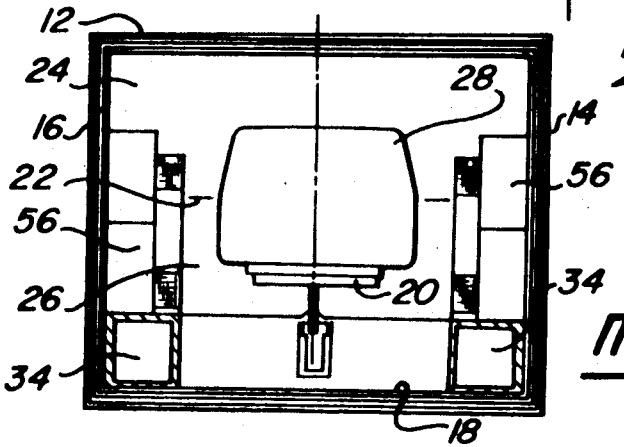
FIG. 5 is a lateral-sectional view at one end of the paint baking oven of FIG. 1 showing a convection air holding zone in cross-section which incorporates radiation panels to assist in heating the recirculation air.
Figure 4:
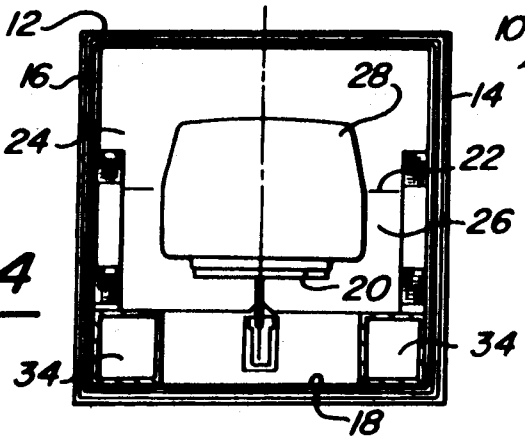
FIG. 4 is a lateral-sectional view at one end of the paint baking oven of FIG. 1 showing a convection air holding zone in cross-section.

Alternatively, dark radiation panels 56 as shown in FIG. 5 can be utilized in conjunction with or in place of the heat pump 52 to reheat the recirculation air. The dark radiation panels 56 aligned along the sidewalls 14 and 16 of paint baking oven 10 between the extending tubes and the sidewalls 14 and 16 cause the recirculation air to become heated as it passes into and through the extending tubes.

Each article 28 generally remains within the convection air holding zone 32 from 10–20 minutes depending on the size and shape of the component being baked and the type and thickness of the paint or other coating used.

The invention has been described with reference to detailed descriptions of preferred embodiments given for the sake of example only. The scope and spirit of the invention are to be determined by the appended claims.

What is claimed:

1. In a paint baking oven having an outer ceiling and a floor interconnected by two side walls to define a tunnel with articles to be baked moving longitudinally along and through the tunnel from an entrance end to an exit end wherein said tunnel contains at least one convection air holding zone, the improvement comprising:

air injection means located adjacent both the entrance and exit ends of said paint baking oven for directing air into said at least one convection air holding zone along a path substantially parallel to the path of travel of the article to be baked; and air distribution means for directing turbulent air longitudinally over said articles along said at least one convection air holding zone.

2. The improvement of claim 1 wherein said air distribution means includes longitudinal partitions extending from both side walls which separate said at least one convection air holding zone into upper and lower sections.

3. The improvement of claim 2 wherein said air distribution means direct turbulent air longitudinally in a first direction in the upper section and in a second direction in the lower section.

4. In a paint baking oven baking an outer ceiling and a floor interconnected by two side walls to define a tunnel with articles to be baked moving longitudinally along and through the tunnel from an entrance end to an exit end wherein said tunnel contains at least one convection air holding zone, the improvement comprising:

air injection means located adjacent both the entrance and exit ends of said paint baking oven for directing air into said at least one convection air holding zone along a path substantially parallel to the path of travel of the article to be baked; and air distribution means for directing turbulent air longitudinally over said articles along said at least one convection air holding zone and including longitudinal partitions extending from both side walls which separate said at least one convection air holding zone into upper and lower sections, and wherein said air distribution means further comprises air circulation means having at least one blower extending from said oven which collects air which has passed through said at least one convection air holding zone and injects said air into longitudinal ducts located along each side of said oven floor within said at least one convection air holding zone, each duct including air tube means through which the air is reintroduced into said at least one convection air holding zone along said upper and lower sections.

5. The improvement of claim 4 wherein said recirculation means includes means for reheating the air collected by said at least one blower for recirculation.

6. The improvement of claim 5 wherein said means for reheating the air collected by said blower comprises a gas furnace.

7. The improvement of claim 5 wherein said means for reheating the air collected by said blower comprises a plurality of dark radiation panels positioned along both side walls of said convection air holding zone.

8. A method of directing turbulent airflow over articles being baked within a convection air holding zone of a paint baking oven, the method comprising the steps of:

(a) introducing an article to be baked into said convection air holding zone;

(b) injecting a volume of heated inlet air into said convection air holding zone through inlet means located at an entrance and an exit end of the holding zone;

(c) exhausting a volume of air containing evaporated solvents and resins from the holding zone, the volume exhausted being substantially equal to the volume of introduced heated inlet air; and (d) recirculating a portion of air in the holding zone by drawing the portion of air through a filtration system and injecting the filtered air through an air duct system which projects the air back into said convection air holding zone with an ejector effect.

9. The method of claim 8 wherein the air being recirculated back into said convection air holding zone is reheated prior to reentering the convection air holding zone.

10. The method of claim 9 wherein the air being recirculated is heated by dark radiation panels as it is reintroduced in the convection air holding zone.

11. In a paint baking oven baking an outer ceiling and a floor interconnected by two side walls to define a tunnel with articles to be baked moving longitudinally along and through the tunnel from an entrance end to an exit end wherein said tunnel contains at least one convection air holding zone, the improvement comprising:

air injection means located adjacent both the entrance and exit ends of said paint baking oven for directing air into said at least one convection air holding zone along a path substantially parallel to the path of travel of the article to be baked; and air distribution means for directing turbulent air longitudinally over said articles along said at least one convection air holding zone and including longitudinal partitions extending from both side walls which separate said at least one convection air holding zone into upper and lower sections, said air distribution means further comprises air recirculation means having at least one blower extending from said oven which collects air which has passed through said at least one convection air holding zone and injects said air into longitudinal ducts located along each side of said oven floor within said at least one convection air holding zone, each duct including air tube means through which the air is re-introduced into said at least one convection air holding zone along said upper and lower sections, said air tube means comprising a plurality of hollow tubes projecting upwardly from said longitudinal ducts, said air tube means including a first end tube which directs a portion of the recirculated air along the upper section of said at least one convection air holding zone toward the center of said paint baking oven, a second end tube which directs a portion of the recirculated air along the lower section of said at least one convection air holding zone away from the center of said paint baking oven and a plurality of tubes located between said first and second end tubes having diametrically opposed air plenums which direct recirculated air into both the upper and lower sections of said at least one air holding zone, the air duct means operated to direct the flow of air in opposite directions along said upper and lower convection air holding zone sections.

12. In a paint baking oven baking an outer ceiling and a floor interconnected by two side walls to define a tunnel with articles to be baked moving longitudinally along and through the tunnel from an entrance end to an exit end wherein said tunnel contains at least one convection air holding zone, the improvement comprising:

air injection means located adjacent both the entrance and exit ends of said paint baking oven for directing air into said at least one convection air holding zone along a path substantially parallel to the path of travel of the article to be baked; and air distribution means for directing turbulent air longitudinally over said articles along said at least one convection air holding zone and including longitudinal partitions extending from both side walls which separate said at least one convection air holding zone into upper and lower sections, said air distribution means further comprises air recirculation means having at least one blower extending from said oven which collects air which has passed through said at least one convection air holding zone and injects said air into longitudinal ducts located along each side of said oven floor within said at least one convection air holding zone, each duct including air tube means through which the air is reintroduced into said at least one convection air holding zone along said upper and lower sections, said air tube means comprising a plurality of hollow tubes projecting upwardly from said longitudinal ducts, said air tube means including a first end tube which directs a portion of the recirculating air along the upper section of said at least one convection air holding zonc toward the center of said paint baking oven and a plurality of tubes located between said first tube and the center of said paint baking oven having upper and lower air plenums which direct recirculated air toward the center of said paint baking oven along said upper and lower convection air holding zone sections.

* * * * *

UNITED STATES PATENT AND TRADEMARK OFFICE

CERTIFICATE OF CORRECTION

PATENT NO. : 5,235,757
DATED : August 17, 1993
INVENTOR(S) : Leif E.B. Josefsson, et al.

It is certified that error appears in the above-indentified patent and that said Letters Patent is hereby corrected as shown below:

On Title Page, in "References Cited" Other Publications, "PCT/US92/07253" should be --PCT/US92/07263--.

Column 6, Line 29, Claim 4, "baking" (2nd occurrence) should be --having--.

Column 6, Line 49, Claim 4, "circulation" should be --recirculation--.

Column 7, Line 44, Claim 11, "comprises" should be --comprising--.

Column 8, Line 16, Claim 12, "baking" (2nd occurrence) should be --having--.

Column 8, Line 34, Claim 12, "comprises" should be --comprising--.

Signed and Sealed this
Fifteenth Day of March, 1994

*Attest:*

*Attesting Officer*

Bruce Lehman

BRUCE LEHMAN

*Commissioner of Patents and Trademarks*